United States Patent [19]

Boot

[11] Patent Number: 4,765,104

[45] Date of Patent: Aug. 23, 1988

[54] BRICK PANEL

[76] Inventor: Phillip H. Boot, 15-17 Bridge Street, Pymble, New South Wales, Australia

[21] Appl. No.: 802,765

[22] Filed: Nov. 27, 1985

[30] Foreign Application Priority Data

Nov. 30, 1984 [AU] Australia ..... PG8374

[51] Int. Cl.[4] ..... E04B 2/00

[52] U.S. Cl. ..... 52/143; 52/169.14; 52/295; 52/442

[58] Field of Search ..... 52/169.14, 293, 295, 52/415, 442, 227, 605, 607, 314, 315, 344, 345, 474, 601, 606, 747, 243, 251, 252, 410; 248/56

[56] References Cited

U.S. PATENT DOCUMENTS

| | | | |
|---|---|---|---|
| 1,441,970 | 1/1923 | D'erville | 52/227 |
| 1,477,665 | 12/1923 | Richman | 52/227 |
| 1,959,816 | 5/1934 | Crum | 52/606 |
| 2,241,169 | 5/1941 | Yokes | 52/228 |
| 2,658,379 | 11/1953 | Allen | 52/601 |
| 2,781,554 | 2/1957 | Robinson . | |
| 2,855,653 | 10/1958 | Kastenbein . | |
| 3,204,376 | 9/1965 | Elgenstierna | 52/410 |
| 3,231,646 | 1/1966 | Conder et al. . | |
| 3,359,354 | 12/1967 | Johnson . | |
| 3,640,046 | 2/1972 | Anderson et al. . | |
| 3,641,731 | 2/1972 | Winfree . | |
| 3,642,395 | 2/1972 | Dreher . | |
| 3,646,715 | 3/1972 | Pope | 52/309.9 |
| 3,715,417 | 2/1973 | Pope . | |
| 3,770,863 | 11/1973 | Elgenstierna . | |
| 3,936,333 | 2/1976 | Behunin | 156/60 |
| 4,165,355 | 8/1979 | Vasilos . | |
| 4,214,408 | 7/1980 | Rich, Jr. | 52/79.1 |
| 4,304,148 | 12/1981 | Hamman | 248/56 |
| 4,532,745 | 8/1985 | Kinard | 52/251 |

FOREIGN PATENT DOCUMENTS

| | | | |
|---|---|---|---|
| 1567346 | 5/1980 | United Kingdom | 52/315 |
| 2089863A | 6/1982 | United Kingdom | 52/474 |

OTHER PUBLICATIONS

Random House College Dictionary, Revised Edition, Random House, Inc. 1980, p. 168 the word "brick".

Engineering News-Record, May 17, 1951, pp. 28, 29 vol. 146, Issue 20.

American Builder, "13 Ways Premolded Membrane Gives "Hidden Value"Protection . . . " May 1959, pp. 212-213.

*Primary Examiner*—David A. Scherbel
*Assistant Examiner*—Andrew J. Rudy
*Attorney, Agent, or Firm*—Murray and Whisenhunt

[57] ABSTRACT

A transportable brick panel consisting of a top reinforced concrete beam, a bottom reinforced concrete beam, brickwork consisting of a plurality of courses of bricks with mortar filled joints extending between said beams and including door or window openings where required, aligned holes passing through some at least of the columns of bricks, reinforcing bars passing through said holes and extending between and being connected with the beams, and a damp course and sealing means on each reinforcing bar where said bar passes through said damp course for preventing passage of moisture along said reinforcing bar. A method of making a transportable brick panel as also described.

7 Claims, 7 Drawing Sheets

BRICK PANEL

The present invention relates to brick wall panels and a method of manufacturing them.

There are many different methods of manufacturing wall panelling, and within the prefabricated building industry these methods are generally well understood. However, only partial success has been achieved in the market-place, the main reason being the lack of aesthetic appeal of the type of panels.

The purpose of the present invention is to provide a brick panel system which fulfills the market criteria whilst allowing significant savings to be gained by rationalisation of the structural elements that constitute a dwelling house.

In most developed countries, the building method known as brick veneer enjoys by far the largest share of the market. This method can be described as a brick veneer constructed around a structural timber or steel framework. The brickwork, in theory anyway, offers no structural assistance to the structural frame and is therefore largely redundant, and it is this factor which concerns the present invention.

It is an object of the present invention to provide an economical method of brick veneer construction in which the brickwork is both the veneer and the structural element in the walls of a dwelling, thus eliminating the necessity for a timber or steel structural framework, whilst still retaining the attributes of a cavity wall system.

It is also an object of the present invention to provide a brick panel manufacturing method that is novel and economical—a necessity in offsetting the transport and erection costs of the panels themselves.

A great failure of industrialised housing has been the necessity for expensive and complex machinery necessary for the manufacture, transport and erection of the prefabricated elements for a masonry type system.

The economical criteria must be:

(a) A simple uncomplicated method of manufacture so as to allow low investment, speedy establishment and, if necessary, rapid relocation of the manufacturing plant to more economical geographical locations.

(b) A simple technique for the actual manufacture of the panel elements themselves, thus enabling semi and unskilled labour to be quickly trained.

(c) To limit the number of operations on site to a minimum and to allow the easy erection of the elements.

(d) Usage of existing configurations of size and positioning of each brick element ensuring that "special" bricks are not necessary for the manufacture of the panels.

(e) A manufacturing method which allows the correct elements to be included such as damp course, cavity, ties, locating brackets, etc.

The present invention consists in a transportable brick panel consisting of a top reinforced concrete beam, a bottom reinforced concrete beam, brickwork consisting of a plurality of courses of bricks with mortar filled joints, extending between said beams and including door or window openings where required, aligned holes passing through some at least of the columns of bricks, reinforcing bars passing through said holes and extending between and being connected with said beams.

The present invention further consists in a method of making a transportable brick panel consisting of the following steps:

(1) Setting out a mould defining the perimeter of a brick panel to be formed, said mould including a flat bottom surface;

(2) Laying a layer of thin soft compressible material on the said surface;

(3) Laying a protective layer of sheet material on said first mentioned layer;

(4) Arranging courses of brickwork in said mould, individual bricks being evenly spaced apart for the reception of fluid mortar, spaced being left at opposite edges of the mould extending the full width of the mould;

(5) Arranging reinforcing bars to pass through aligned holes in columns of bricks so as to extend into said spaces;

(6) Arranging reinforcing bars to extend longitudinally in said spaces;

(7) Pouring concrete into said spaces and allowing it to set to form top and bottom reinforced concrete beams;

(8) Pouring mortar to fill spaces between individual bricks and allowing it to set;

(9) Lifting the brick panel so formed from the mould and cleaning the brickwork if required.

It is preferred that the thin compressible material be porous and resilient. It is preferred that the protective layer of sheet material be water absorbent and that this layer be treated with a cement retardant preparation.

Where door or window openings are required suitable blockouts are introduced with the brickwork.

In order that the nature of the invention may be better understood and put into practice a preferred form thereof is hereinafter described by way of example with reference to the accompanying drawings in which.

In the manufacture of a brick wall panel, a flat table mould 10 is required, manufactured of any suitable material such as steel or timber and of sufficient size to enable manufacture of the largest panel required.

Figure 1:
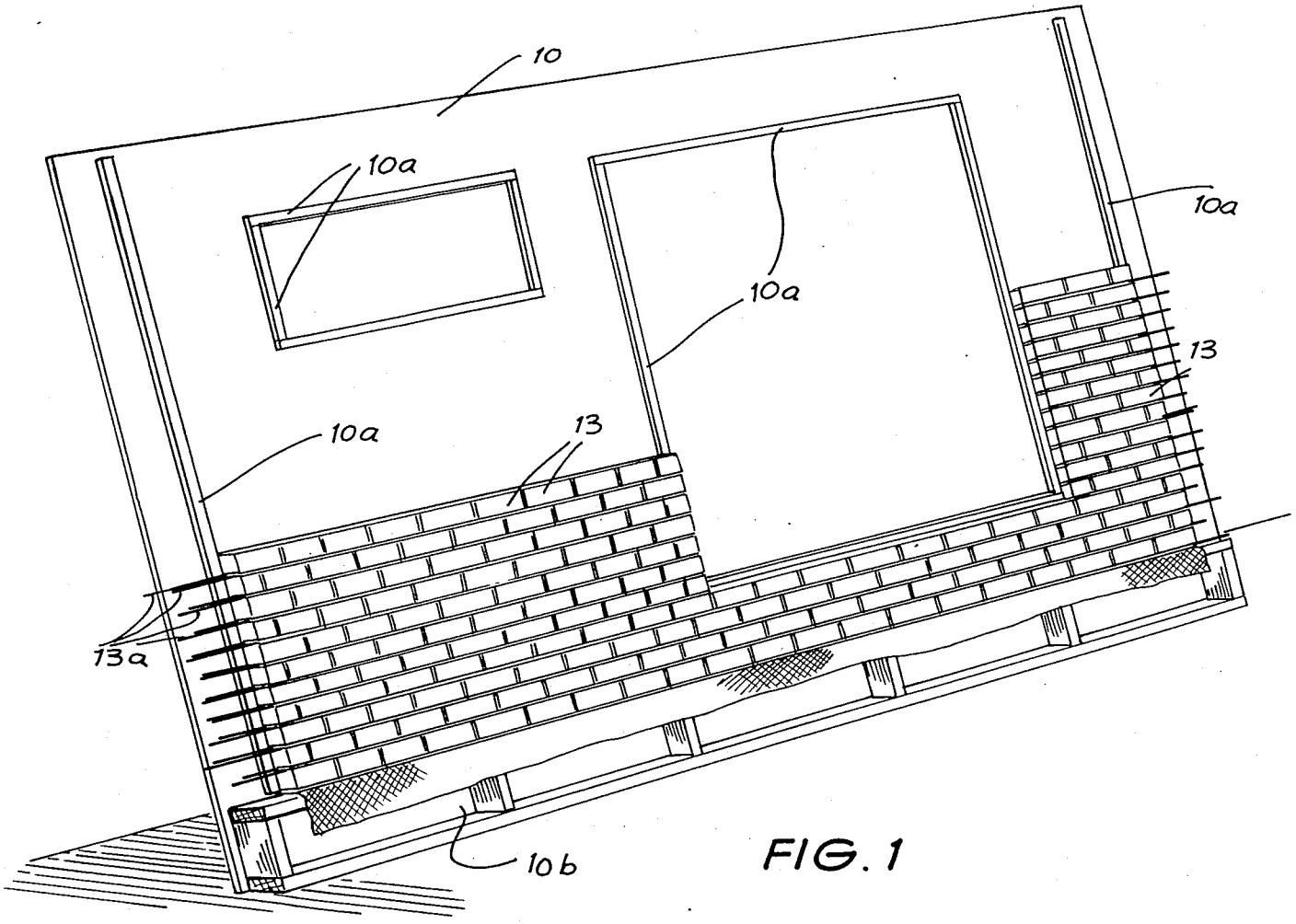
FIG. 1 is a perspective view of a brick panel according to the invention in the course of construction.

In FIG. 1 the mould 10 is shown tilted to a near vertical position for the placing of the bricks of the panel as described below. Initially, however, it is placed horizontally.

Figure 2:
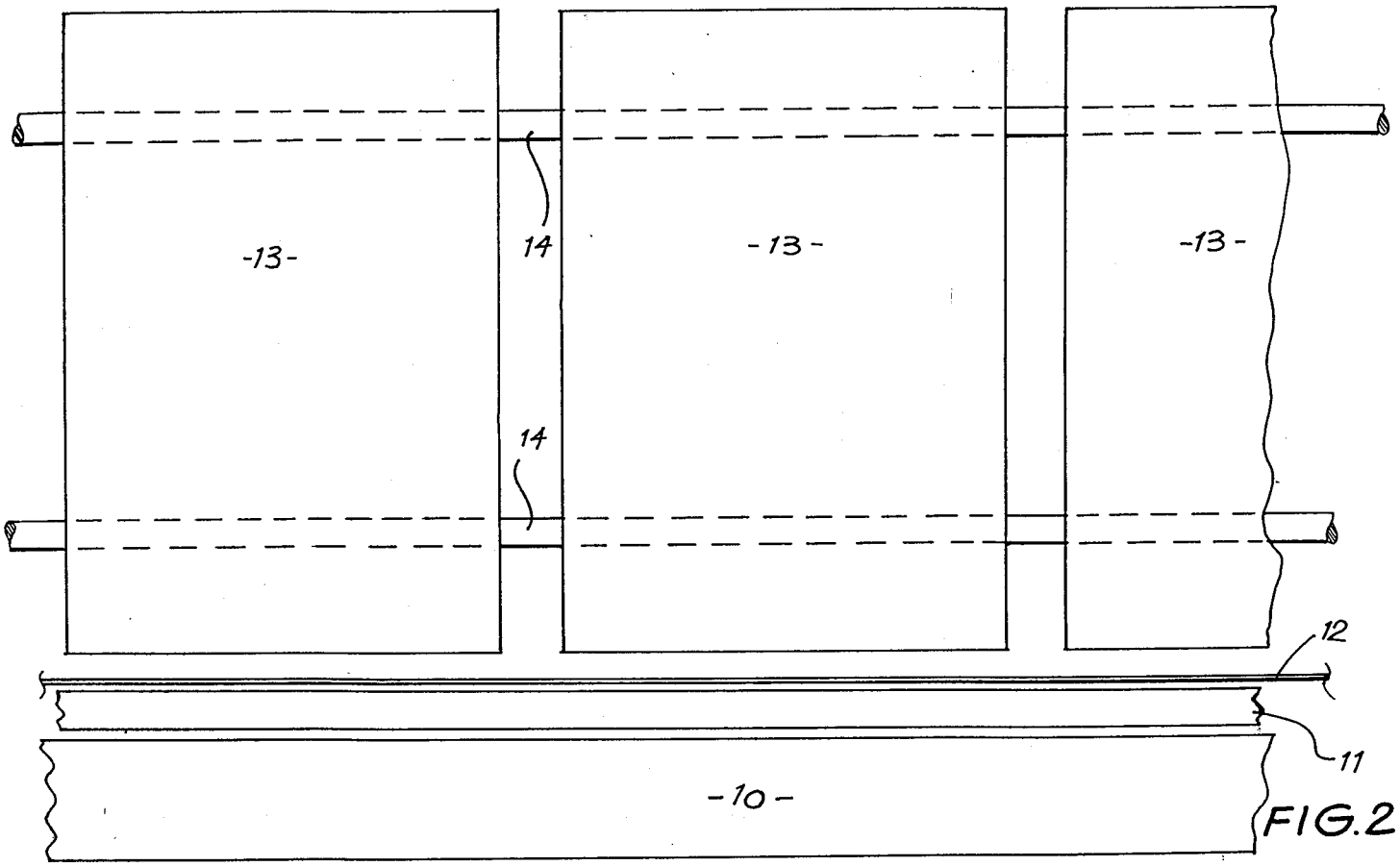
FIG. 2 is a cross-sectional view to an enlarged scale of a portion of the panel under construction.

A membrane 11 (see FIG. 2) is placed upon the mould surface with the mould 10 in the horizontal position. The membrane 11 consists of a thin, preferably porous resilient compressible material, e.g. sheet of soft foam rubber or soft foam plastic of approximately 4 mm thickness. Over this resilient compressible material is placed a protective layer of sheet material 12 that is suitably flexible, e.g., very thin plastic or alternatively a porous, absorbent material, e.g., sheet paper of newsprint grade 12. This absorbent and porous skin is preferably treated with a water soluble cement retardant, or suitable release agent.

The configuration of the brick panel is set out and defined on its vertical edges by sub-edgeboards 10*a*. These are fixed in position on the mould 10 as shown in FIG. 1.

The void that defines the bottom concrete beam is temporarily filled with a blockout structure 10*b* (see FIG. 1). The mould is then raised to an almost vertical position as shown in FIG. 1, at least within 2-°25° of vertical so that the bricks rest against the mould. Tte bricks 13 are then placed face against the membrane and spaced apart with dowels 13*a* laid horizontally between each layer of bricks until all the bricks in the panel are in position. Vertical joints are gauged by eye only an obviously are related to bond and window/door positioning. Window and door openings are positioned prior to positioning the bricks 13 and are in the form of sub-edgeboards 10*a*, the sub-edgeboards being approximately 10 mm in depth thus ensuring a proper dimensional blockout for installation of the actual window or door frames. The mould 10 is then lowered back to the approximate horizontal position.

Reinforcing bars 14 are inserted from the top of the panel through the holes in the bricks until they pass through to the bottom layer of bricks. The solid blockout 10*b* that defines the bottom beam 15 and was supporting the bricks during their placement is withdrawn.

Figure 7:
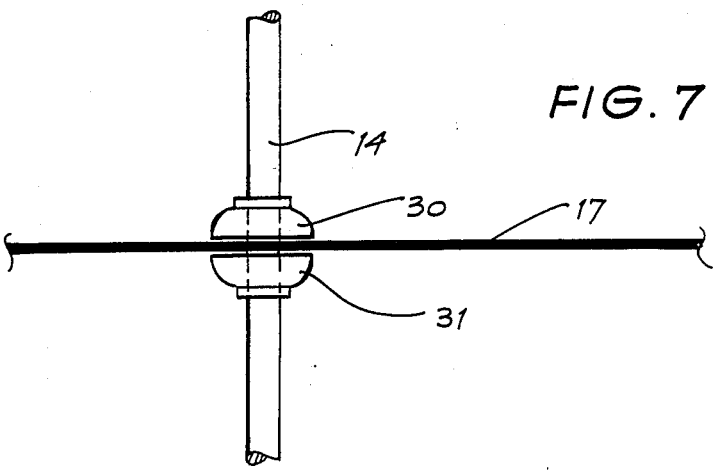
FIG. 7 is a detail showing the arrangement of the damp course seals on a retaining bar.
Figure 8:
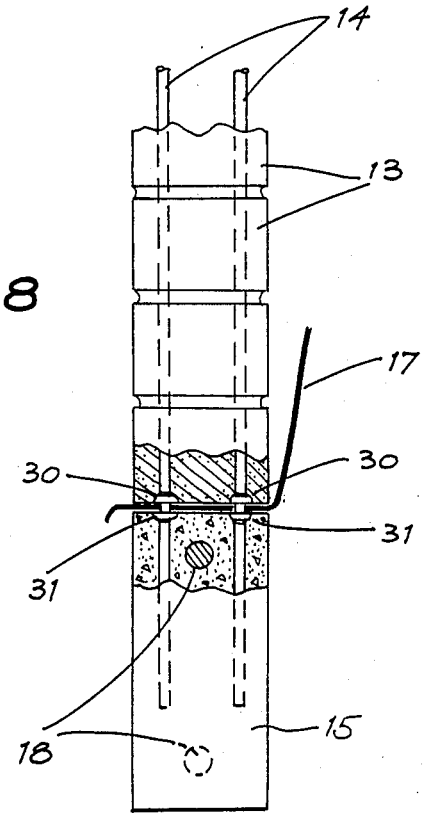
FIG. 8 is a part-sectional end elevation of a portion of a panel illustrating the location of a damp course seals.
Figure 9:
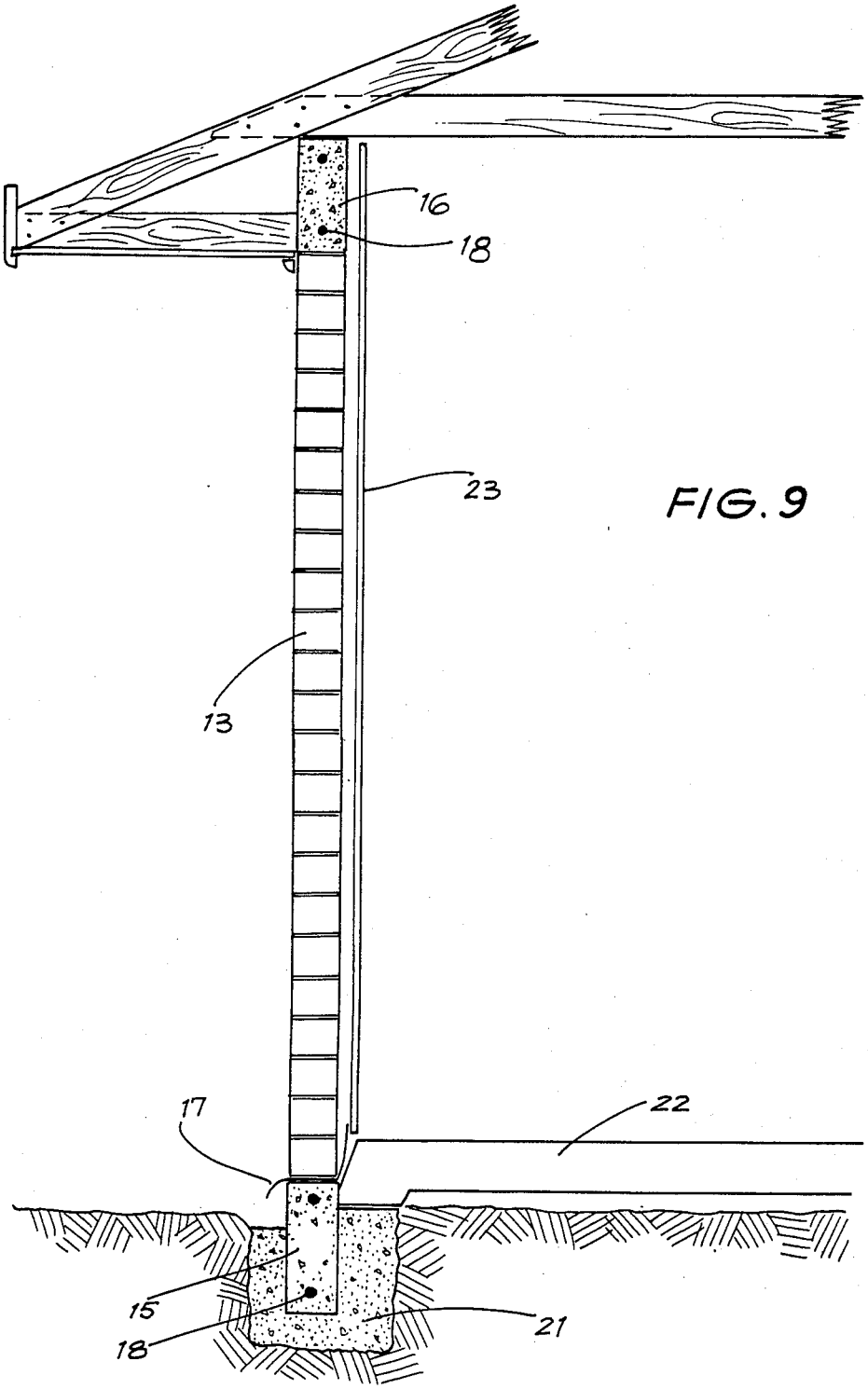
FIG. 9 is an end view of a wall panel incorporated into a building structure.

A damp course upper seal 30 (see FIGS. 7 and 8) is then attached to these bars 14 and then the bars are passed through the now positioned damp course 17 (bottom beam 15 only) whereupon the damp course lower seal 31 is attached, thus effectively sandwiching the damp course I7 between the two seals.

The reinforcing bars 14 are usually under 10 mm in diameter and preferably treated to resist corrosion, e.g., galvanising or epoxy coated. This reinforcing varies in size and quantity according to the structural and handling requirements.

At the bottom and top of the panel spaces for reinforced concrete beams 15 and 16 are formed. These beams are approximately the same thickness as the brick panel and are as wide as the base of the panel itself. The depth of these beams can vary depending on the ultimate structural requirements of the panel itself, but, for example, a brick veneer construction on reasonable soil conditions would require beams approximately 200 to 350 mm deep.

The beam reinforcement 18 for both top and bottom beams is positioned and attached where applicable to the brick reinforcement bars 14 and as with the beam size can vary to suit. The bars 14 can also if desired be bent or hooked at their ends to improve their performance. Edgeboards e.g. 10*c* (FIG. 3) for the beams are positioned. Next a concrete mix is poured into the beam voids. Care must be taken at the top beam not to allow the concrete mix to run down the vertical brick joints.

When this is complete and the concrete has set sufficiently, e.g., it is no longer in a mobile state, the dowels 13*a* are withdrawn. Edgeboards (not shown) for the brickwork are now placed in position on the mould 10, preferably with a porous material, e.g., paper, separating the brick end/faces from the edgeboard.

When this is complete weepholes are blocked out with packing material, e.g., polystyrene, in some of the vertical joints directly above the damp course.

Figures 3, 4:
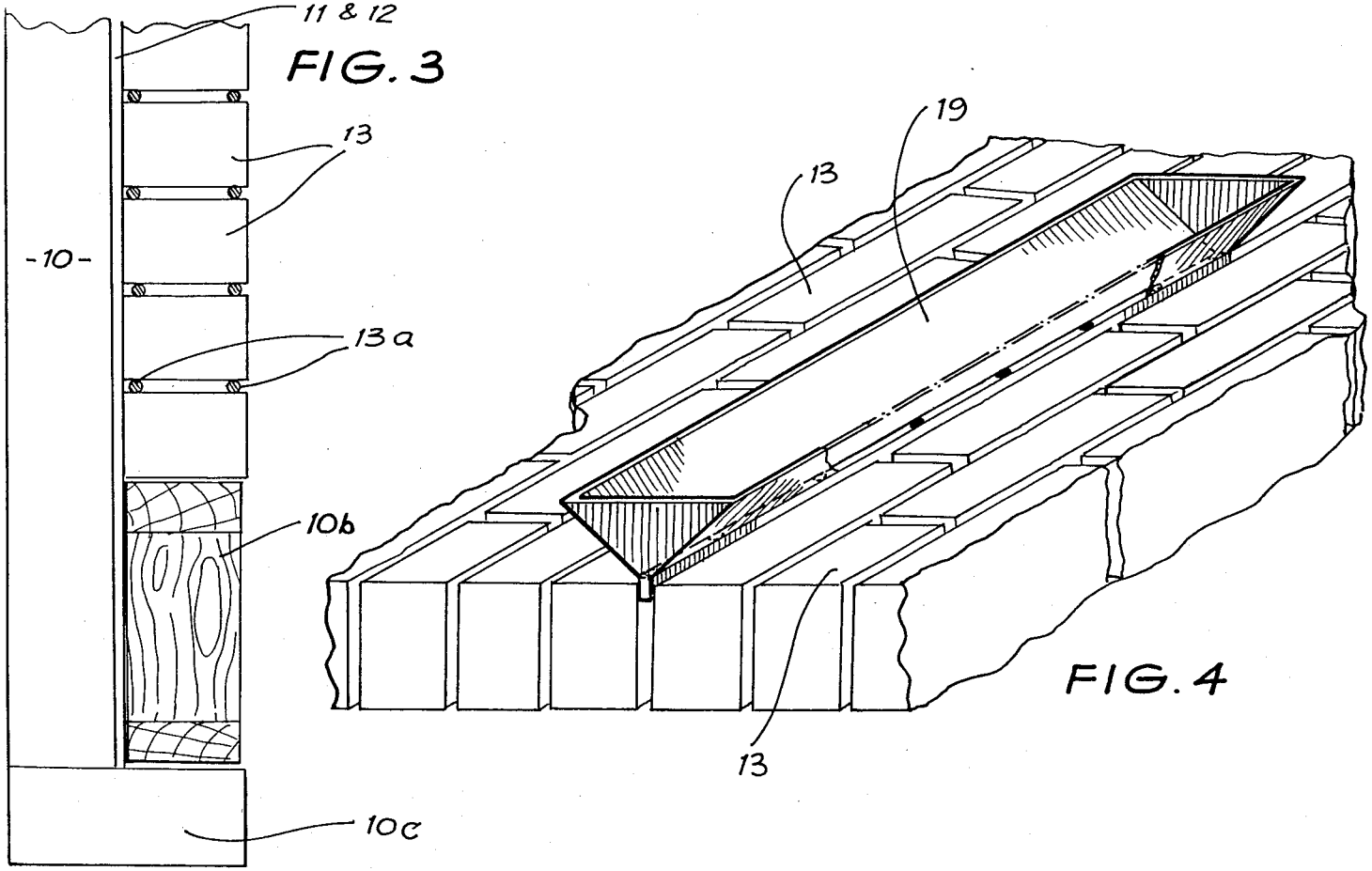
FIG. 3 is an end elevation of the lower part of the panel under construction.
FIG. 4 is a perspective view illustrating the step of introducing mortar into joints between the bricks.
Figure 5:
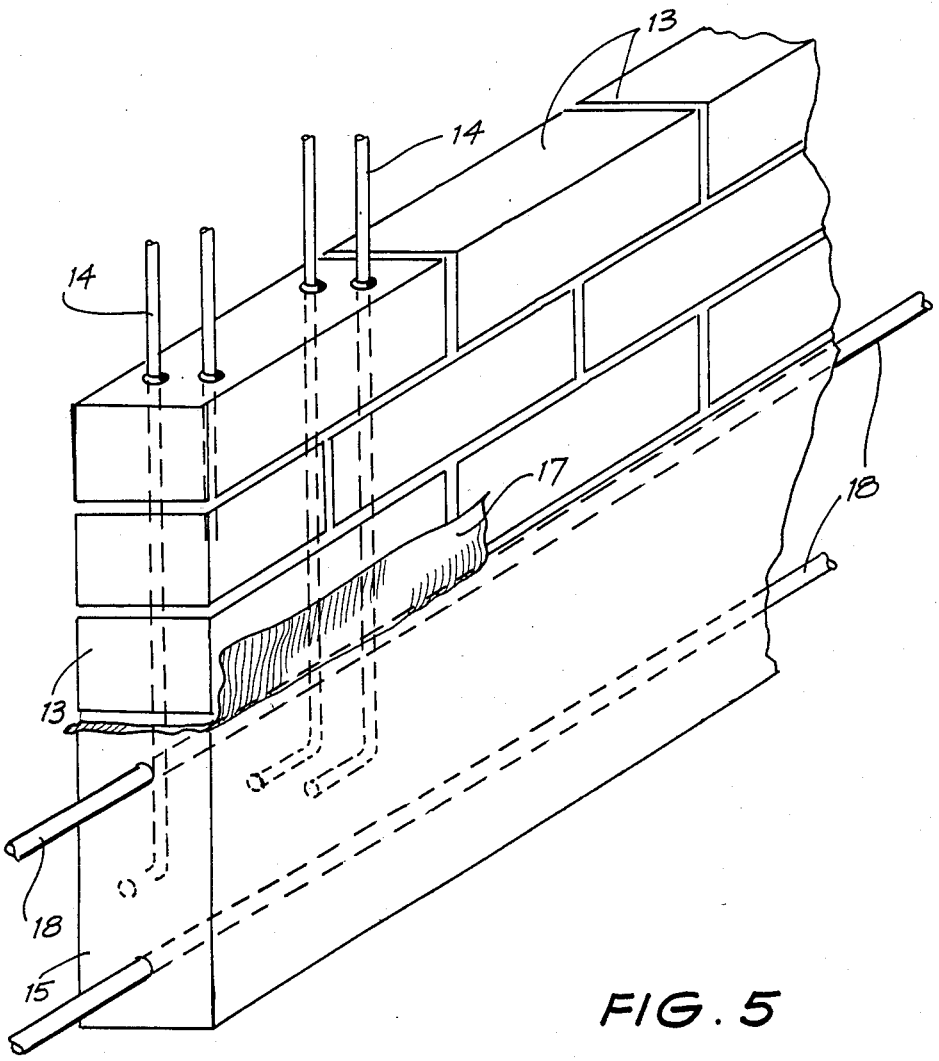
FIG. 5 is a perspective view of one end of a portion of a panel showing the damp course.
Figure 6:
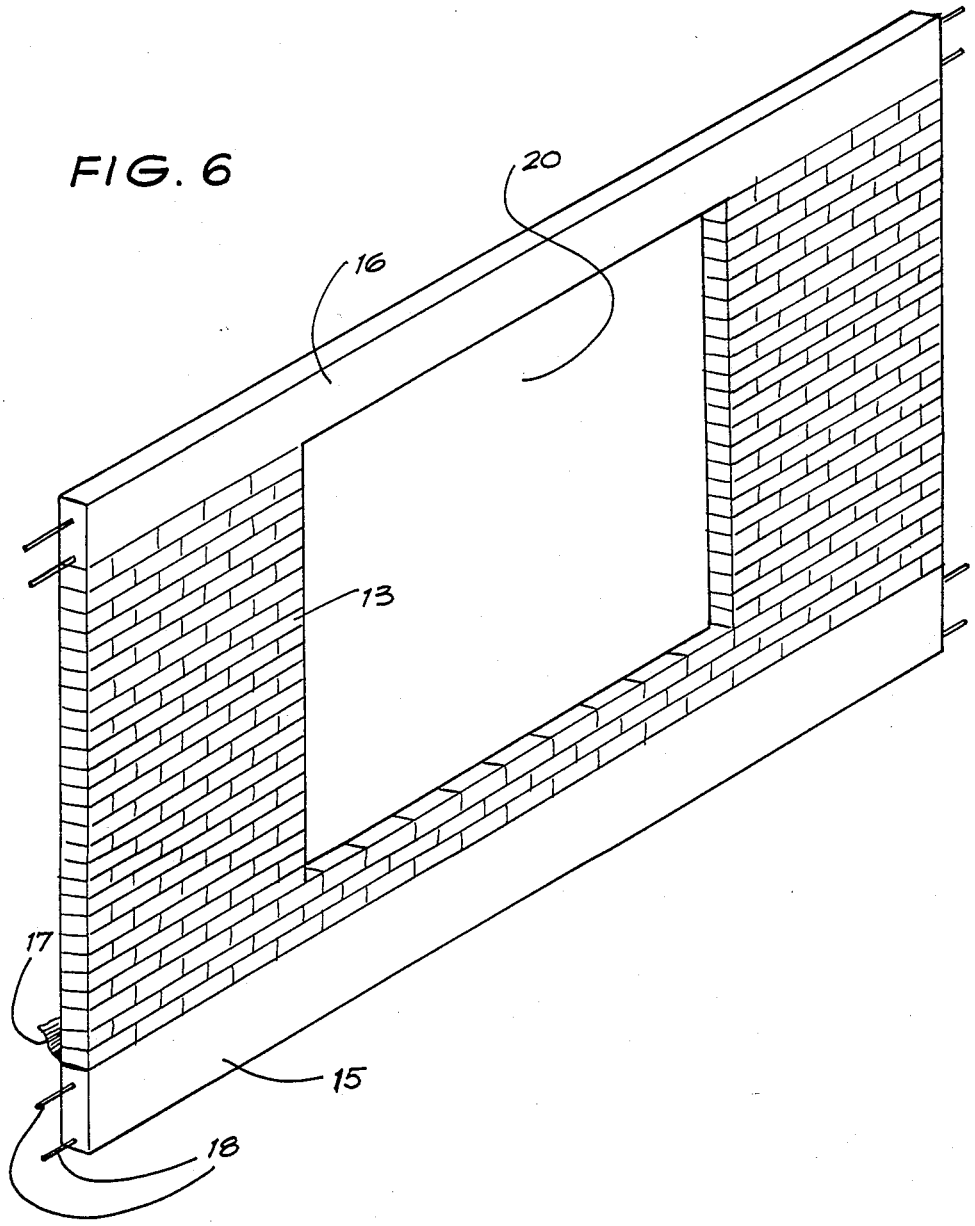
FIG. 6 is a perspective view of a typical brick panel according to the invention.

Because it is important to introduce the liquid mortar directly into the joints between the bricks (the reason for this is so as to generate a cross flow effect when mortar filling causing air pockets trapped in all the many holes, etc., to be evacuated more efficiently) mortar troughs 19 are placed at various horizontal joint intervals (as shown in FIG. 4) so as to facilitate fast and clean introduction of the mortar into the brick joints.

Other feeder troughs can convey the mortar quickly to the brick joint troughs. The mortar mix must be very liquid and pour readily, e.g., run easily through a 10 mm hole in a funnel. This fluidity is preferably achieved by the use of water reducing superplasticisers.

When this is complete the panel is cured sufficiently before tilting vertically and separating from the mould. This is therefore the reason to treat the protective layer of paper 12 with a cement retardant, or release agent thus enabling the paper, which will adhere to the brick panel, to be peeled away and the brickwork then brushed and any blemishes rectified.

The function of the membrane 11 together with the protective layer 12 is to prevent the fluid mortar from contaminating the face suface of the bricks as well as stabilise the brick in its preferred position. The compressable resilient nature of the membrane allows the brick to "sink in", thus being able to resist lateral forces generated during the preparation or the introduction of the fluid mortar.

The membrane in its natural state must be flat and *not* moulded to any brick pattern shape as the mould and its membrane have to accommodate many different panel wall configurations. It is important that its deformation takes place after or during the placement of the bricks or during the placement of the fluid mortar and that its configuration of deformation be dictated by the weight and positioning of the bricks and also that the configuration of the bricks can be altered or changed at any time prior to the placement of mortar and that the membrane will adjust or re-adjust to accommodate the alternatives.

The membrane's resilience and compressability should be of sufficient character so that the weight of the bricks cause sufficient deformation to effect a satisfactory seal, accommodate irregularities in the surface and surface/edge of the brick face and accommodate any small pieces of brick which inadvertantly during handling and placement are dislodged under the brick and could prevent the brick from sitting flat. The bricks used weighed approximately 3.3 kgs and had a surface area on the membrane of 0.01748m$^2$ each and exerted a load of approximately 190 kgs per m$^2$. The deformations on the brick surface are approximately 1 to 3 mm deep.

The protective layer 12 assists the membrane's characteristics by becoming extremely soft and pliable. This is achieved by its absorption of moisture either from the bricks during and after placement and from the fluid mortar. Once pliable and more flexible it expands and allows the membrane by releasing load on it to expand up into the joints between the bricks and effect a suitable seal around the perimeter of the bricks.

It also combines with the membrane 11 to absorb excess water from the fluid mortar called "free water" which is required to cause the mortar to be fluid. This prevents the mortar from flowing around, marring the faces of the bricks. The filtered water is then transmitted and absorbed by the foam membrane 11 described previously. This basic function of the paper membrane is important, as is its function in preventing setting of the mortar which results from its treatment with a water soluble retardant.

The brick panel described in this specification varies from the prior types in that it is made in conjunction with its concrete beams. It is possible to reinforce brick panels horizontally as well as vertically, However, obtaining adequate cover of the reinforcing, particularly bars greater than 10 mm, is very difficult.

Concrete strength also is a vital factor as concrete technology is well understood and quite predictable. High strength mortars, however, although well documented are not so predictable when variables such as water/cement ratio, wet or dry bricks, rate of absorption of bricks and shrinkage (one of the main consistent problems) remain unprecise.

In the brick and concrete panel described in this specification the concrete elements perform the following functions.

In the case of a normal single storey dwelling the bottom beam is designed to form part of the foundation and therefore is about the same depth as a typical foundation. The top beam supports the roof loads. It is possible that the concrete beams could be much reduced in depth, particularly in the usage of brick panels in multistorey buildings. By concrete is meant material having a large aggregate of a size no smaller than 5 mm.

By contrast the mortar mix which is basically sand, cement and water, if cast in this type of void, say larer than 509 mm deep beam, would be subject to excessive shrinkage leading to structural and corrosion problems.

However, this panel and its manufacture also lends itself to being the outer leaf of a "sandwich" type panel. The bottom and top concrete beams could be made thicker if desired so as to structurally join an inner leaf either laid or poured on top of the bricks whilst still on the mould, the two leaves being separated by insulating material or a removable formwork, thus leaving a cavity. The inner leaf could be concrete or any other suitable material and either structural or in some cases non-structural as defined in the explanation on Brick Veneer construction.

By bricks is meant both clay and cementicious base types.

A further feature of this panel system is the inclusion of a horizontal damp course close to the base of the panel. Whilst it would be possible to position the damp course at any desired height within the panel, it does not negate the structural effect of the damp course on the panel itself. It divides the panel by breaking the bond between the courses of bricks or in this case the bottom concrete beam and the first layer of brick courses.

The brick reinforcing, however, should preferably structurally "join" the two members separated by the damp course. The damp course for this reason is preferred to be as thin as possible and flexible so that irregularities are moulded together when the concrete and 'ater the mortar are poured against one another. These 'regularities act as "keys" assisting to prevent delami- 'tion of the panel at the damp course joint. It is there- 'e preferable that the brick reinforcement bars con- 'e through the damp course and by doing so create 'her problem in that the hole created would allow 'ure to travel through the damp course. This is 'vely eliminated by the use of upper and lower rubber grommett seals which sandwich the damp course between them and grip tightly around the reinforcing bars. By rubber is meant any elastomeric natural or synthetic material capable of performing this task.

Another feature of this panel system is its ability to preserve what is considered very desirable features of normal cavity wall construction. It must be assumed that the external brick wall or panel in this case retains some degree of moisture that is unacceptable for the interior wall of a dwelling. Further compounding this problem is the incidence of condensation, which in some climates renders the single wall systems virtually uninhabitable. A barrier is necessary between the outside wall and the inside lining. This barrier can be clear air space or some type of insulation material, e.g., polystyrene, polyurethane, etc.

With this brick panel system it is proposed to have this barrier as an integral part of the overall system. The simplest method of achieving this goal is by attaching battens to the wall of varying thickness to suit climatic requirements and then attaching drywall plasterboard to those battens. The battens themselves can be made of any suitable material and bonded directly to the wall with a material and bonding agent suitable for that use. Indeed the cavity could be filled entirely with any suitable insulation material, e.g. polystyrene, polyurethane, etc.

If, however, as in some countries, a clear uninterrupted cavity is required, the following method is preferred.

The batten can be made of timber or steel or of another suitable structural material and of a section and strength that is compatible with the spacing of the attachments or fixings to the brick panel. These fixings must hold the batten out from the wall in a fixed position, ie, away from the wall and yet also to the wall.

The drywall plasterboard can then be fixed directly to the batten by any of the conventional means. The rest of the internal walling to make up the configuration of rooms to suit the dwelling design-layout is done in a conventional manner, using any of the conventional materials and labour. It is obvious, however, that further industrialisation and prefabrication is possible to reduce the on site activity and accelerate the completion date. So far only single storey construction has been described, as well as only using the brick panel wall in panel form.

I claim:

1. A transportable brick panel, comprising:

a top reinforced concrete beam;

a bottom reinforced concrete beam;

brickwork comprising a plurality of courses of bricks, having mortar filed joints, extending between said beams, said brickwork defining a plurality of columns of bricks extending between said beams;

aligned holes passing through at least some of said columns of bricks;

reinforcing bars passing through said holes and through at least some of said columns of bricks, said reinforcing bars extending between and being connected with said beams, and;

a damp course and sealing means on each reinforcing bar where said bar passes through said damp course for preventing passage of moisture along said reinforcing bar.

2. A transportable brick panel as claimed in claim 1, and including door openings.

3. A transportable brick panel as claimed in claim 1, and including window openings.

4. A transportable brick panel as claimed in claim 1, and including door and window openings.

5. A transportable brick panel as claimed in claim 1, wherein said damp course is arranged between a lowermost course of brick and said bottom reinforced concrete beam.

6. A transportable brick panel as claimed in claim 1, wherein said sealing means on each reinforcing bar consists of a pair of grommets of elastomeric material which fit closely around said reinforcing bar and are arranged immediately above and below said damp course.

7. A transportable brick panel, comprising:

a top reinforced concrete beam;

a bottom reinforced concrete beam;

brickwork comprising a plurality of courses of bricks, having mortar filled joints, extending between said beams, said brickwork defining a plurality of columns of bricks extending between said beams;

aligned holes passing through at least some of said columns of beams;

reinforcing bars passing through said holes and through at least some of said columns of bricks, said reinforcing bars extending between and connecting to said beams, substanially all of said reinforcing bars being at least substanially parallel to one another;

damp course means located between said brick courses and said bottom reinforced concrete beam for at least substanially preventing moisture passage between said bricks and said bottom reinforced concrete beam, said reinforcing bars passing through said damp course means; and seal means on each reinforcing bar where said bar passes through said damp course means preventing moisture passage through said damp course means at said reinforcing bars.

* * * * *